US009177765B2

(12) United States Patent
Olney

(10) Patent No.: US 9,177,765 B2
(45) Date of Patent: Nov. 3, 2015

(54) METHOD FOR AUTOMATED CHECKING AND ADJUSTMENT OF MASS SPECTROMETER CALIBRATION

(75) Inventor: Terry N. Olney, Tracy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/356,572

(22) PCT Filed: Nov. 29, 2011

(86) PCT No.: PCT/US2011/062324

§ 371 (c)(1),
(2), (4) Date: May 6, 2014

(87) PCT Pub. No.: WO2013/081581

PCT Pub. Date: Jun. 6, 2013

(65) Prior Publication Data

US 2014/0306106 A1 Oct. 16, 2014

(51) Int. Cl.
*H01J 49/26* (2006.01)
*H01J 49/00* (2006.01)

(52) U.S. Cl.
CPC ..... *H01J 49/0009* (2013.01); *H01J 49/004* (2013.01); *H01J 49/0031* (2013.01); *H01J 49/26* (2013.01)

(58) Field of Classification Search
CPC .. H01J 49/0009; H01J 49/004; H01J 49/0031
USPC ..... 250/281, 282, 287, 288, 252.1, 283, 250/290, 299, 300
See application file for complete search history.

(56) References Cited

U.S. PATENT DOCUMENTS

| | | | | |
|---|---|---|---|---|
| 4,847,493 | A * | 7/1989 | Sodal et al. | 250/252.1 |
| 6,586,727 | B2 * | 7/2003 | Bateman et al. | 250/282 |
| 7,518,104 | B2 * | 4/2009 | Gabeler | 250/282 |
| 7,675,031 | B2 | 3/2010 | Konicek et al. | |
| 2003/0042415 | A1 * | 3/2003 | Hager | 250/282 |
| 2004/0051039 | A1 * | 3/2004 | Russ et al. | 250/288 |
| 2006/0023808 | A1 * | 2/2006 | Hajivandi et al. | 375/297 |
| 2006/0169883 | A1 * | 8/2006 | Wang et al. | 250/282 |
| 2006/0284080 | A1 | 12/2006 | Makarov et al. | |

(Continued)

OTHER PUBLICATIONS

Barwick et al. "Best Practice Guide for Generating Mass Spectra" Dec. 2006.*

Sparkman. O. David, "Mass Spectrometry Desk Reference," Global View Publishing, Pittsburgh, PA, ISBN 0-9660813-2-3, (2000), pp. 1-3 , 39.

(Continued)

*Primary Examiner* — Michael Logie
(74) *Attorney, Agent, or Firm* — Thomas F. Cooney

(57) ABSTRACT

A method for automatically checking and adjusting a calibration of a mass spectrometer having a first quadrupole (Q1), a fragmentation cell and a mass analyzer comprises: introducing a sample having at least one known chemical entity; decreasing a kinetic energy so as to prevent fragmentation of ions in the fragmentation cell; optionally applying a drag field to the fragmentation cell; ionizing the at least one known chemical entity sample to generate a set of ions; performing a mass scan of the set of ions using Q1; transmitting the scanned ions through Q1 to and through the fragmentation cell; detecting the scanned and transmitted ions by a detector of the mass analyzer; and comparing the results with expected results. Embodiments may include automatic recalibration or notification of possible errors, need for further data processing or an analysis of system performance.

33 Claims, 8 Drawing Sheets

(56) References Cited

U.S. PATENT DOCUMENTS

| | | | | |
|---|---|---|---|---|
| 2007/0003941 | A1* | 1/2007 | Olson et al. | 435/6 |
| 2007/0145264 | A1 | 6/2007 | Specht et al. | |
| 2009/0095898 | A1* | 4/2009 | Collings et al. | 250/282 |
| 2011/0057095 | A1* | 3/2011 | Loboda | 250/282 |
| 2011/0121165 | A1* | 5/2011 | Watling et al. | 250/282 |
| 2011/0284740 | A1* | 11/2011 | Okumura | 250/288 |
| 2014/0117219 | A1* | 5/2014 | Kenny | 250/252.1 |

OTHER PUBLICATIONS

Presser, "Agilent 6400 Series Triple Quadrupole LC/MS/MS Users Session; QQQ Method Development and Optimization," XP055193026, https://www.chem.agilent.com/Library/posters/Public/QQQ_Method_Development_Triple_and Optimizsation.pdf, 2009, pp. 1-46.

* cited by examiner

METHOD FOR AUTOMATED CHECKING AND ADJUSTMENT OF MASS SPECTROMETER CALIBRATION

CROSS-REFERENCE TO RELATED APPLICATIONS

This application is the United States National Stage application, under 35 USC 371, of International Application No. PCT/US2011/062324 having an international filing date of Nov. 29, 2011 and designating the United States, said international application incorporated by reference herein in its entirety.

TECHNICAL FIELD

The instant invention relates generally to the field of mass spectrometry, and more particularly to apparatus and methods for mass spectrometer calibration.

BACKGROUND ART

In a simple mass spectrometry (MS) system, ions of a sample are formed in an ion source, such as for instance an Electron Impact (EI) source, an electrospray (ESI) source or an Atmospheric Pressure Ionization (API) source. The ions then pass through a mass analyzer, such as for instance a quadrupole (Q) or a time of flight (TOF) device, for detection. The detected ions include at least one of molecular ions, fragments of the molecular ions, and fragments of other fragment ions.

Tandem mass spectrometry (MS/MS) systems have been developed and are well known. Such tandem systems are characterized by having two or more sequential stages of mass analysis and an intermediate ion fragmentation, where ions from the first stage are fragmented into product ions for analysis within the second stage. There are two basic types of tandem mass spectrometers, namely those that are "tandem in space" and those that are "tandem in time." Tandem-in-space mass spectrometers, such as for instance triple quadrupole (QqQ) and quadrupole-time of flight (Q-TOF) devices, have two distinct mass analyzers, one for precursor ion selection and one for product ion detection and/or measurement. An ion fragmentation device, such as for instance a gas-filled collision cell, is disposed between the two mass analyzers for receiving ions from the first mass analyzer and for fragmenting the ions to form product ions for introduction into the second mass analyzer. Tandem-in-time instruments, on the other hand, have one mass analyzer that analyses both the precursor ions and the product ions, but that does so sequentially in time. Ion trap and FT-ICR are two common types of mass spectrometer that are used for tandem in time MS/MS.

Several MS/MS scan types, in particular "product ion scan", "precursor ion scan" "neutral loss scan," and Selected Reaction Monitoring (SRM) scan are known. Performing a "product ion scan" is done by selecting a particular precursor ion in the first MS stage, and then obtaining in the second MS stage a full scan of the product ions that are formed when the selected precursor ion is fragmented. A "precursor scan," is a method that has a fixed product ion selection for the second MS stage, while using the first MS stage to scan all of the pre-fragmentation precursor ions in a sample. Detection is limited to only those molecules/compounds in the sample that produce a specific product ion when fragmented. In the SRM mode, only a specific precursor/product ion pair is monitored. Multiple precursor/product ion pairs can be monitored during a specific analysis. Finally, a "neutral loss scan" is a method that supports detection of all precursor ions that lose a particular mass (non-charged) during fragmentation. The second stage mass analyzer scans the ions together with the first stage mass analyzer, but with a predetermined offset corresponding to the lost mass. Neutral loss scans are used for screening experiments, where a group of compounds all give the same mass loss during fragmentation.

In theory and in practice, the steps of selecting ions and fragmenting the selected ions can be repeated iteratively. For instance, an MS/MS/MS (or $MS^3$) analysis would include a precursor ion selection step, a fragmentation step that produces first-generation product ions by fragmentation of the selected precursor ion(s), a product-ion selection step, a second fragmentation step that produces second-generation product ions from the selected first-generation product ions and, finally, mass analysis of the second-generation product ions. The symbolism $MS^N$ (N an integer) is sometimes used to indicate tandem mass spectrometry experiments that include N generations of ions (a first generation consisting of precursor ions followed by N−1 generations of product ions). According to this same scheme, simple, non-tandem mass spectrometry is denoted by $MS^1$ or, simply, MS.

FIG. 1A is a schematic illustration of an example of a conventional mass spectrometer system, shown generally at 200, capable of providing collisional ion dissociation. Referring to FIG. 1A, an ion source 212 housed in an ionization chamber 24 is connected to receive a liquid or gaseous sample from an associated apparatus such as for instance a liquid chromatograph or syringe pump through a capillary 207. As but one example, an atmospheric pressure electrospray source is illustrated. However, any ion source may be employed, such as a heated electrospray ionization (H-ESI) source, an atmospheric pressure chemical ionization (APCI) source, an atmospheric pressure matrix assisted laser desorption (MALDI) source, a photoionization source, or a source employing any other ionization technique or a combination of the above techniques. The ion source 212 forms charged particles 209 (either ions or charged droplets that may be desolvated so as to release ions) representative of the sample. The charged particles 209 are subsequently transported from the ion source 212 to the mass analyzer 39 in high-vacuum chamber 226 through intermediate-vacuum chambers 218 and 225 of successively lower pressure in the direction of ion travel. In particular, the droplets or ions are entrained in a background gas and may be transported from the ion source 212 through an ion transfer tube 216 that passes through a first partition element or wall 215*a* into an intermediate-vacuum chamber 218 which is maintained at a lower pressure than the pressure of the ionization chamber 24 but at a higher pressure than the pressure of the high-vacuum chamber 226. The ion transfer tube 216 may be physically coupled to a heating element or block 223 that provides heat to the gas and entrained particles in the ion transfer tube so as to aid in desolvation of charged droplets so as to thereby release free ions.

Due to the differences in pressure between the ionization chamber 24 and the intermediate-vacuum chamber 218 (FIG. 1A), gases and entrained ions are caused to flow through ion transfer tube 216 into the intermediate-vacuum chamber 218. A second plate or partition element or wall 215*b* separates the intermediate-vacuum chamber 218 from a second intermediate-pressure region 225, likewise a third plate or partition element or wall 215*c* separates the second intermediate pressure region 225 from the high-vacuum chamber 226. A first ion optical assembly 27*a* provides an electric field that guides and focuses the ion stream leaving ion transfer tube 216 through an aperture 222 in the second partition element or wall 215*b* that may be an aperture of a skimmer 221. A second ion optical assembly 27*b* may be provided so as to transfer or guide ions to an aperture 227 in the third plate or partition element or wall 215*c* and, similarly, another ion optical assembly 27*c* may be provided in the high vacuum chamber 226 containing a mass analyzer 39. The ion optical assemblies or lenses 27*a*-27*c* may comprise transfer elements, such as, for instance a multipole ion guide, so as to direct the ions through aperture 222 and into the mass analyzer 39. The mass analyzer 39 comprises one or more detectors 48 whose output can be displayed as a mass spectrum. Vacuum ports 213, 217 and 219 may be used for evacuation of the various vacuum chambers.

The mass spectrometer system 200 (as well as other such systems illustrated herein) is in electronic communication with a controller 15 which includes hardware and/or software logic for performing data analysis and control functions. Such controller may be implemented in any suitable form, such as one or a combination of specialized or general purpose processors, field-programmable gate arrays, and application-specific circuitry. In operation, the controller effects desired functions of the mass spectrometer system (e.g., analytical scans, isolation, and dissociation) by adjusting voltages (for instance, RF, DC and AC voltages) applied to the various electrodes of ion optical assemblies 27*a*-27*c* and quadrupoles or mass analyzers 33, 36 and 39, and also receives and processes signals from detectors 48. The controller 15 may be additionally configured to store and run data-dependent methods in which output actions are selected and executed in real time based on the application of input criteria to the acquired mass spectral data. The data-dependent methods, as well as the other control and data analysis functions, will typically be encoded in software or firmware instructions executed by controller. A power source 18 supplies an RF voltage to electrodes of the devices and a voltage source 21 is configured to supply DC voltages to predetermined devices.

As illustrated in FIG. 1A, the conventional ion trap mass spectrometer system 200 is a triple-quadrupole system comprising a first quadrupole device 33, a second quadrupole device 36 and a third quadrupole device 39, the last of which is a mass analyzer comprising one or more ion detectors 48. The first, second and third quadrupole devices may be denoted as, using common terminology, as Q1, Q2 and Q3, respectively. A lens stack 34 disposed at the ion entrance to the second quadrupole device 36 may be used to provide a first voltage point along the ions' path. The lens stack 34 may be used in conjunction with ion optical elements along the path after stack 34 to impart additional kinetic energy to the ions. The additional kinetic energy is utilized in order to effect collisions between ions and neutral gas molecules within the second quadrupole device 36. If collisions are desired, the voltage of all ion optical elements (not shown) after lens stack 34 are lowered relative to lens stack 34 so as to provide a potential energy difference which imparts the necessary kinetic energy.

Various modes of operation of the triple quadrupole system 200 are known. In some modes of operation, the first quadrupole device is operated as an ion trap which is capable of retaining and isolating selected precursor ions (that is, ions of a certain mass-to-charge ratio, m/z) which are then transported to the second quadrupole device 36. More commonly, the first quadrupole device may be operated as a mass filter such that only ions having a certain restricted range of mass-to-charge ratios are transmitted therethrough while ions having other mass-to-charge ratios are ejected away from the ion path 45. In many modes of operation, the second quadrupole device is employed as a fragmentation device or collision cell which causes collision induced fragmentation of selected precursor ions through interaction with molecules of an inert collision gas introduced through tube 235 into a collision cell chamber 37. The second quadrupole 36 may be operated as an RF-only device which functions as an ion transmission device for a broad range of mass-to-charge ratios. In an alternative mode of operation, the second quadrupole may be operated as a second ion trap. The precursor and/or fragment ions are transmitted from the second quadrupole device 36 to the third quadrupole device 39 for mass analysis of the various ions.

The ion optical assemblies 27*a*-27*c* and quadrupole devices 33, 36, 39, as known to those of ordinary skill in the art, can form an ion path 45 from the ionization chamber 24 to at least one detector 48. The electronic controller 15 is operably coupled to the various devices including pumps, sensors, ion source, ion guides, collision cells and detectors to control the devices and conditions at the various locations throughout the mass spectrometer system 200, as well as to receive and send signals representing the particles being analyzed. If the second quadrupole device 36 is to be used only as a collision or fragmentation cell (or, in general, a reaction cell), then the second quadrupole device may be replaced by a hexapole or higher order multipole device or any other device that acts similarly, such as a stacked ring ion guide.

FIG. 1B illustrates a portion of a mass spectrometer system including a curved collision cell 36. Other not-illustrated components of the mass spectrometer system may be similar to those illustrated in FIG. 1A. Because of the curved shape of the collision cell 36, which is also denoted as Q2, the first 33 and third 39 quadrupole devices (also denoted Q1 and Q3, respectively) are oriented at an angle to one another and the ion path 45 is correspondingly curved. Ions are maintained within the collision cell 36 in the usual fashion by the confining effects of the quadrupole fields generated by oscillating potentials applied to the curved rod electrodes comprising the collision cell 36. In addition, auxiliary electrodes may be disposed within or around the collision cell in order to provide a drag field within the collision cell that functions to urge ions through the collision cell along the curved ion path 45. The configuration of quadrupole devices shown in FIG. 1A aids in manufacturing a compact size mass spectrometer and also facilitates separation of ions from neutral gas molecules, which are not deflected along the curved portion of the ion path 45.

Quadrupole scanning mass spectrometers operate by RF and DC voltages applied to various electrodes over time. Calibrations are used to convert voltage values into m/z values and to convert detected intensity values into abundance values. A full tuning and calibration procedure includes adjustments and optimizations of an ion source, lenses and detectors followed by introduction into the instrument of one or more calibrant compounds that yield ions having well-known m/z and intensity values. Such tuning and calibration procedures may be performed at regular intervals—for instance, weekly or monthly. Unfortunately, however, instrumental operation can drift with time between regularly scheduled calibrations, diminishing the accuracy of prior calibrations and requiring more frequent monitoring and calibration.

In high throughput clinical laboratory settings, it is important that instrument calibrations remain up-to-date. However, in these same environments, it is often inconvenient to perform frequent un-scheduled re-calibrations, since numerous urgent analyses of patient samples may be delayed. Accordingly, there is a need for methods and apparatus that can perform quick calibration tests and minor calibration adjustments to compensate for instrumental drift without requiring a full instrumental tuning and re-calibration procedure.

DISCLOSURE OF INVENTION

A method for automatically checking and adjusting a calibration of a mass spectrometer that includes an ion source, a first quadrupole device (Q1), a second quadrupole device (Q2) comprising a fragmentation cell such as a collision cell and a mass analyzer is provided. The automatic method may be performed periodically during a sequence of mass analyses of a plurality of samples provided to the mass spectrometer, the sequence including the introduction of one or more internal standards or other well-characterized or known chemical entities to the mass spectrometer. The mass spectrometer is of a type which is capable of performing tandem-in-space mass spectrometry in which precursor ions are selected and isolated in a first spectrometer stage; the selected and isolated ions are fragmented or otherwise reacted or manipulated so as to generate product ions in a second spectrometer stage; and the product ions are analyzed within a third mass spectrometer stage. The first stage (Q1) may comprise a mass filter or a mass storage device such as a linear ion trap or may even comprise a mass analyzer including its own respective detector. The second stage may comprise a collision cell or reaction cell in which a collision gas or reagent gas is provided so as to promote or cause fragmentation of ions by collisions or other interactions between the precursor ions and the collision or reagent gas. The second stage may comprise a quadrupole device, in which case it may be denoted as Q2. The third stage includes an ion detector and may comprise a third quadrupole (Q3) in which case the mass spectrometer is a standard "triple-quadrupole" mass spectrometer. Alternatively, however, the mass analyzer may comprise a time-of-flight mass analyzer, an electrostatic trap or Orbitrap™-type of mass analyzer, or some other type of mass analyzer.

According to various embodiments in accordance with the present teachings, periodic calibration verification and possible re-calibration of the mass spectrometer may be performed between regularly scheduled full tuning and calibration procedures. Such mass spectrometer calibration verification may be performed by observing mass peaks of one or more known chemical entities within various routine samples introduced into the mass spectrometer. The one or more known chemical entities may include components known to exist in the various analytical samples (e.g., the samples on which actual determinative measurements are made) without requiring addition of any components or inclusion of additional samples.

Any rigorous analytical program that is designed so as to produce consistently accurate and precise analytical data of verifiable quality will generally incorporate many known chemical entities as part of the overall program. For example, internal standards are known chemical substances that are chemically similar but not identical to analyte substances. Internal standards are routinely added to analytical samples as well as to control samples such as blank samples and analyte-specific calibration samples. The internal standards are added in known and well-defined quantities and are employed so as to account for or correct for losses of analytes during sample preparation, handling and analysis. Analyte-specific calibration samples are samples that are prepared with initially well-known quantities of a calibrant material that is a chemical substance which is similar to or, preferably, identical to an analyte substance whose quantity is to be measured in unknown samples. The analyte-specific calibration samples are often prepared as a series of samples of different concentrations of the analyte so that an instrumental calibration curve—specific to that analyte—may be generated. Commonly, multiple analytes may be measured simultaneously and, thus, multiple calibration curves are required. Blank samples are samples that are prepared and analyzed in the same fashion as analytical samples but to which unknown materials are not introduced. The blank samples, which may nevertheless contain internal standards, are used to monitor for laboratory contamination. Finally, Analytical Quality Control (AQC) samples are periodically introduced samples that may contain known quantities of certified reference materials in order to monitor the consistency and reproducibility of a sample analysis program.

In some embodiments, the entire sample or components therein may be used to check spectral quality or perform the calibration verification. In some embodiments, several samples and standards may be analyzed together and one or more of these may be used to check the spectral quality or perform the calibration verification. In some embodiments, the sample being analyzed will contain a known compound or compounds (e.g. a known chemical entity such as an internal standard) which will be used to check spectral quality or perform the calibration verification. The known chemical entity may be alternatively analyzed both for MS/MS quantization and in MS mode. This may be implemented by performing one MS analysis or scan on the known chemical entity for every N quantitative MS/MS analyses or scans of the known chemical entity and unknown samples.

For purposes of the present disclosure, the one or more known chemical entities, such as the internal standards or other characterized compounds, may be employed so as to provide at least one well known or well characterized precursor ion species (possibly together with other ion species) during ionization in an ion source of the mass spectrometer. One exemplary method in accordance with the present teachings therefore comprises:

(a) providing a sample having therein at least one known chemical entity;
(b) decreasing a kinetic energy applied to ions entering a fragmentation cell of a mass spectrometer so as to prevent fragmentation therein;
(c) optionally, applying a drag field to the fragmentation cell;
(d) ionizing the at least one known chemical entity using the ion source so as to generate ions of a known precursor ion species;
(e) performing a mass scan of a portion of the set of ions using Q1;
(f) transmitting the scanned ions from Q1 to the fragmentation cell so as to be transmitted through the fragmentation cell;
(g) detecting the scanned and transmitted ions by a detector of a mass analyzer of the mass spectrometer; and
(h) comparing the results of the detection of the scanned transmitted ions with expected results.

In various embodiments, the known precursor ion species may be produced by ionization of an internal standard within an analytical sample a blank sample or a quality control sample. The known chemical entity may be an internal standard or a calibrant material and, may, in some cases, comprise one or more compounds added to a sample for purposes of quality control or calibration of a concentration scale. In some embodiments, the known chemical entity may be chemically similar to or even identical to an analyte. In various embodiments, the known precursor ion species may be produced by ionization of a standard sample whose introduction into the mass spectrometer is interspersed between two of a plurality of analytical samples. The interspersing may be performed automatically by a computer or other automated controller device electrically coupled to the mass spectrometer under the control of automated sample preparation and analysis scheduling software. In various embodiments, the application of the drag field to the fragmentation cell, if performed, comprises applying a drag field configured to urge ions to follow a curved path through a second quadrupole device Q2. In various embodiments, the mass analyzer may comprise a quadrupole device, Q3. Alternatively, the mass analyzer may comprise a time-of-flight or an electrostatic trap or a magnetic sector mass analyzer. The quadrupole devices Q2 and Q3 may be operated in RF-only mode to facilitate the transmitting of ions therethrough.

Various embodiments of the method may additionally comprise:

(i) determining, from the comparison, if any of a peak centroid position, peak intensity, peak width or peak resolution differs from a respective expected value by greater than a respective tolerance; and (j) performing one or more of the steps of: j1) providing a data quality score for the sample, j2) determining if mass calibration or peak resolution has drifted and recalibration is necessary, j3) monitoring deviations of centroid position, peak resolution or intensity over time to predict when future recalibration or system cleaning will be necessary, and j4) adjusting a calibration applied to one or more of the plurality of samples.

In various embodiments, the step (j) above may comprise providing a notification, if any of the peak centroid position, peak width or known sample intensity differs from the respective expected value by greater than the respective tolerance, that prior or current experimental results may be in error, that a full instrument tuning, re-calibration or cleaning is needed, or that further post-acquisition processing or analysis of previously obtained results is required. The step (j) may include predicting future system failure or providing information relating to the suitability of an assay batch. Some embodiments may include an additional step of adjusting, post-data-acquisition, a calibration applied to one or more of the plurality of samples if any of the peak centroid position, peak width or peak resolution differs from the respective expected value by greater than the respective tolerance.

Another exemplary method in accordance with the present teachings comprises:

(a) providing a sample having therein at least one known chemical entity;

(b) decreasing a kinetic energy applied to ions entering the fragmentation cell so as to prevent fragmentation therein;

(c) ionizing known chemical entity using the ion source so as to generate ions of a known precursor ion species;

(d) optionally, applying a drag field to the fragmentation cell;

(e) transmitting a portion of the ions through Q1;

(f) transmitting the ions from Q1 to the fragmentation cell so as to be transmitted through the fragmentation cell to a mass analyzer;

(g) performing a mass analysis of the transmitted ions by the mass analyzer; and (h) comparing the results of the mass analysis with expected results.

In various embodiments, the known precursor ion species may be produced by ionization of an internal standard within an analytical sample a blank sample or a quality control sample. The known chemical entity may be an internal standard or a calibrant material and, may, in some cases, comprise one or more compounds added to a sample for purposes of quality control or calibration of a concentration scale. In some embodiments, the known chemical entity may be chemically similar to or even identical to an analyte. In various embodiments, the known precursor ion species may be produced by ionization of a standard sample whose introduction into the mass spectrometer is interspersed between two of a plurality of analytical samples. The interspersing may be performed automatically by a computer or other automated controller device electrically coupled to the mass spectrometer under the control of automated sample preparation and analysis scheduling software. In various embodiments, the application of the drag field to the fragmentation cell, if performed, comprises applying a drag field configured to urge ions to follow a curved path through a second quadrupole device Q2. In various embodiments, the mass analyzer may comprise a quadrupole device, Q3. Alternatively, the mass analyzer may comprise a time-of-flight or an electrostatic trap or a magnetic sector mass analyzer. In various embodiments, the quadrupole devices Q1 and Q2 may be operated in RF-only mode to facilitate the transmitting of ions therethrough.

Various embodiments of the method may additionally comprise:

(i) determining, from the comparison of the results of the detection of the known precursor ion species with expected results, if any of a peak centroid position, peak resolution or known sample intensity differs from a respective expected value by greater than a respective tolerance; and (j) performing one or more of the steps of: j1) providing a data quality score for the sample, j2) determining if mass calibration or peak resolution has drifted and recalibration is necessary j3) monitoring deviations of centroid position, peak resolution or intensity over time to predict when future recalibration or system cleaning will be necessary, and j4) adjusting a calibration applied to one or more of the plurality of samples.

In various embodiments, the step (j) above may comprise providing a notification, if any of the peak centroid position, peak width or known sample intensity differs from the respective expected value by greater than the respective tolerance, that prior or current experimental results may be in error, that a full instrument tuning, re-calibration or cleaning is needed, or that further post-acquisition processing or analysis of previously obtained results is required. The step (j) may include predicting future system failure or providing information relating to the suitability of an assay batch. Some embodiments may include an additional step of adjusting, post-data-acquisition, a calibration applied to one or more of the plurality of samples if any of the peak centroid position, peak width or peak resolution differs from the respective expected value by greater than the respective tolerance.

BRIEF DESCRIPTION OF DRAWINGS

The above noted and various other aspects of the present invention will become apparent from the following description which is given by way of example only and with reference to the accompanying drawings, not drawn to scale, in which.

MODES FOR CARRYING OUT THE INVENTION

Figure 1A:
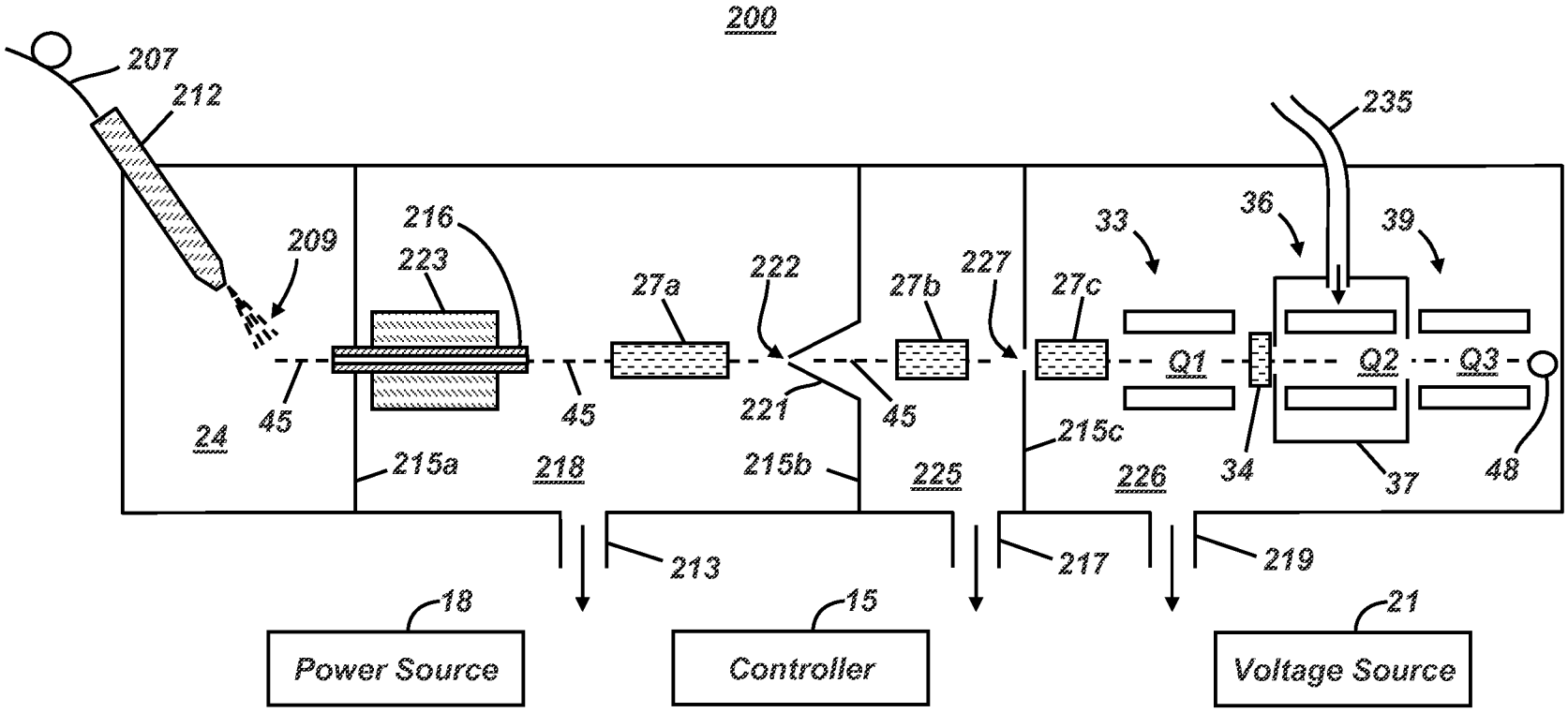
FIG. 1A (Prior Art)
FIG. 1A is a schematic illustration of an example of a conventional triple quadrupole mass spectrometer in which collisional ion dissociation may be performed.

The present invention provides novel methods for calibration of a mass spectrometer and, in particular, a mass spectrometer comprising a fragmentation cell stage, such as a collision-cell disposed between two other stages, at least one of which is a mass analyzer stage. The following description is presented to enable one of ordinary skill in the art to make and use the invention and is provided in the context of a particular application and its requirements. It will be clear from this description that the invention is not limited to the illustrated examples but that the invention also includes a variety of modifications and embodiments thereto. Therefore the present description should be seen as illustrative and not limiting. While the invention is susceptible of various modifications and alternative constructions, it should be understood that there is no intention to limit the invention to the specific forms disclosed. On the contrary, the invention is to cover all modifications, alternative constructions, and equivalents falling within the essence and scope of the invention as defined in the claims.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding. To more particularly describe the features of the present invention, please refer to the attached FIGS. 1-4 in conjunction with the discussion below.

Figure 1B:
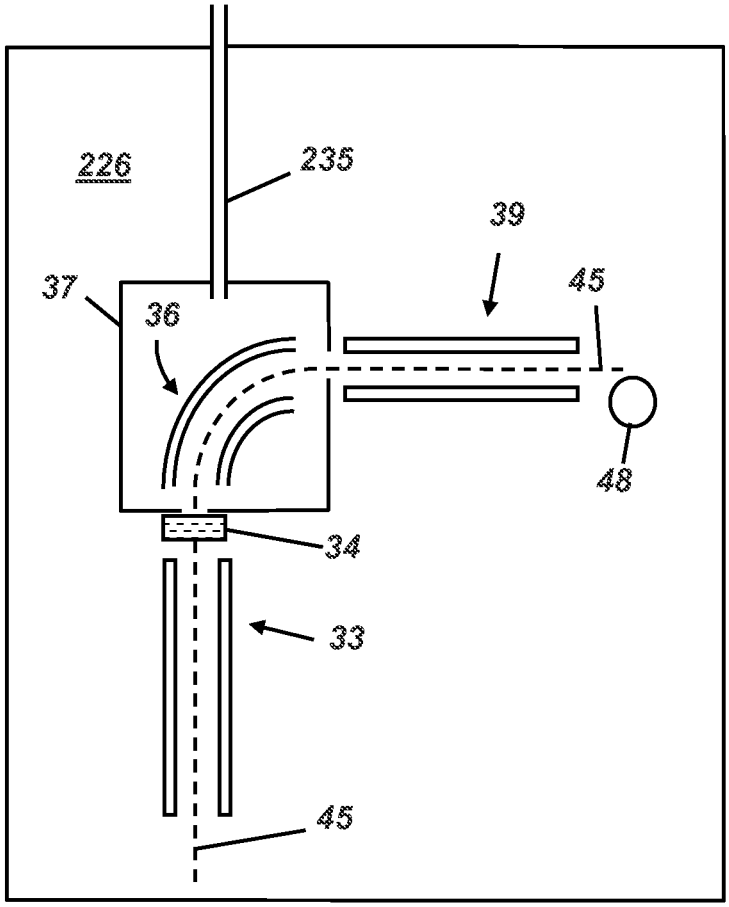
FIG. 1B (Prior Art)
FIG. 1B is a schematic illustration of a compactly-sized curved collision cell that may be employed within a triple quadrupole mass spectrometer.
Figure 2A:
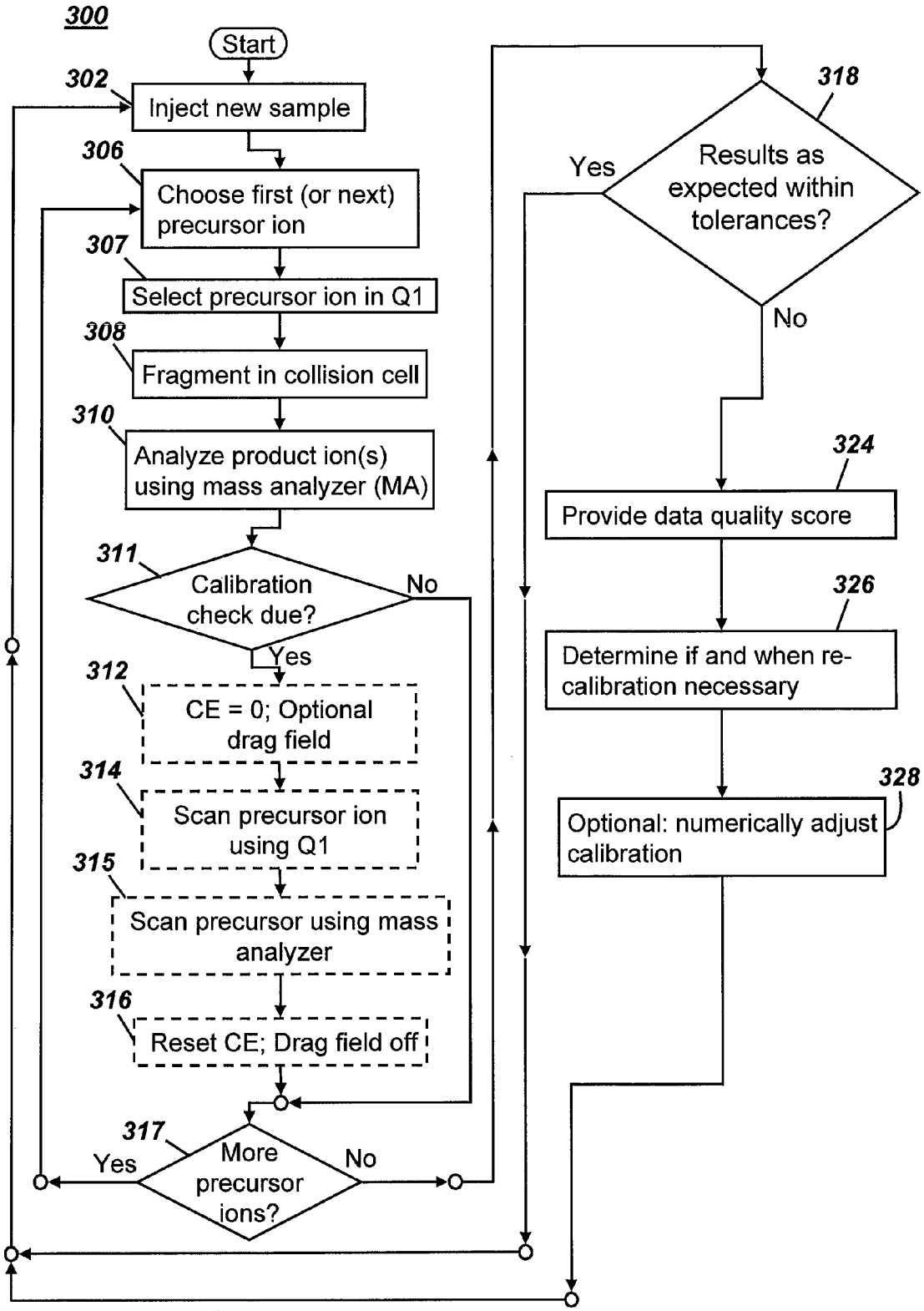
FIG. 2A is a flow chart of a method for operating a mass spectrometer while periodically checking and, optionally, adjusting a calibration of the mass spectrometer in accordance with the present teachings.

As noted above, it may often be inconvenient or impractical to perform frequent full calibrations or re-calibrations within a mass spectrometer employed in a clinical laboratory environment or other high-throughput analytical environment, since numerous urgent analyses of samples may be delayed. Furthermore, automatically classifying the data as good, suspect or bad in real time can be critical in assessing the confidence of a result having a specified time limit ("time-to-result") for completion of the result. Therefore, FIG. 2A illustrates an automated method 300 of operating a mass spectrometer and periodically performing a mass calibration check of the mass spectrometer. The method 300 is suitable for calibration verification or, optionally, for minor calibration adjustments to correct for instrumental drift between scheduled full tuning and calibration procedures. The method 300 is applicable to a mass spectrometer having a first mass filter stage (Q1), a fragmentation or collision cell stage and a second mass filter or other mass analyzer stage as illustrated in FIG. 1A. The collision cell may be straight, as shown in FIG. 1A or, alternatively, curved as shown in FIG. 1B. The collision cell may comprise a quadrupole device, in which case it may be denoted as Q2. The mass analyzer may comprise another quadrupole device, in which case it may be denoted as Q3.

Prior to executing the method 300, the mass axis scales and mass resolution (or, equivalently, peak width) of both Q1 and the mass analyzer (for example, Q3) are calibrated using one or more calibrant masses during execution of a full tuning and calibration procedure. The mass axis scales and peak widths of subsequent experiments or analytical runs may employ these initial calibrations so that such mass scales are correctly calculated, displayed and reported and such that the correct peak widths are used. After the full tuning and calibration procedure, each analysis is performed employing one or more iterations of at least the steps 302, 306, 307, 308, 310, 311 and 317 and also, in the case of a calibration verification, steps 312-316 and 318-328. In this discussion, the term "sample" is used generally to indicate any of an analytical sample, a blank sample, a quality control sample, etc. In general, a sample being utilized for a calibration verification will contain a known compound or compounds (e.g., an internal standard) which will be generally be analyzed using MS/MS quantization (in the case of routine analyses) and, occasionally in MS mode (during calibration verification). The calibration verification steps (steps 312-316, 318-326 and, optionally, step 328) may be implemented by performing MS scans on the internal standard for every N quantitative MS/MS scans of the various samples or, alternatively, after every M samples.

To further elucidate the above ideas, the various steps in the method 300 are here described in sequence. In Step 302, a new sample is injected into the mass spectrometer and ionized in an ionization source of the mass spectrometer. The subsequent steps 306, 307, 308 and 310 are MS/MS steps that are performed on every sample. In Step 306, a particular precursor ion of interest is chosen according to a pre-determined list of diagnostic precursor ions. In Step 307, the chosen precursor ion is selected from a suite of ions of an ionized sample by using the selective mass filtering (or, alternatively selective isolation and mass storage) properties of the Q1 stage. Because the sample may include a plurality of precursor ions of interest, the Steps 306-311 may be executed multiple times for each sample depending upon the evaluation of the decision step, Step 317. The precursor ion selection uses the current or most recent mass-axis calibration of the Q1 stage in order to properly indentify and properly transmit or select ions having the correct mass-to-charge ratio.

In Step 308 of the method 300 (FIG. 2A), the selected precursor ion is transmitted to the fragmentation or collision cell stage where it is fragmented so as to form product ion(s) using a selected collision energy (CE). Then, in Step 310, the product ions are transmitted from the fragmentation cell to the mass analyzer stage, in which one or more of the product ion(s) are analyzed. If the mass analyzer comprises a quadrupole device (Q3), the mass analysis may be performed by scanning the Q3 mass analyzer stage and detecting the product ions during the scanning. Such detection of product ions uses current or most recent mass-axis calibration of the Q3 stage to ensure that ions of the correct mass-to-charge ratio (or ratios) are detected. Also, a calculated ion abundance may utilize a currently used or most recent calibration of a detector intensity scale. The end result of Step 310 is a signal that represents an amount of product ions detected as a result of fragmentation of the selected precursor ions.

The decision step, Step 311, determines if a calibration check is due to be performed. In a normal situation (i.e., a normal cycle) a calibration check is not due and, accordingly, execution of the method 300 branches from Step 311 to Step 317. Periodically, however—for instance, after a particular number of sample analyses or scans or after a particular time interval after a prior calibration check or if a particular sample is flagged for a calibration check—the sequence of steps 312-316, shown with dashed line boxes in FIG. 2A, is executed. The steps 312-316 form part of the calibration verification. In some instances, the sample employed for the calibration check may be a special known or standard sample interspersed with routine analytical samples. More commonly, however, the internal standard or standards used for the calibration check are already included as one or more components of the various calibrators, quality control samples, other control samples and unknowns. This way it is not necessary to have additional samples added to an already busy instrument. In the sequence of steps 312-316, the calibrations of either or both Q1 and the mass analyzer (for example, Q3) may be checked using detected precursor peaks generated from the internal standard.

In step 312 of the method 300, the CE of the collision cell stage is decreased to a level below the threshold of collisions by reducing accelerating voltages imparted to ions and a drag field may optionally be applied to the collision cell by applying voltages to auxiliary electrodes (in addition to an RF oscillatory voltage applied to the quadrupole rods). A "drag field" refers, in this context, to an electric field which serves to urge ions through the collision cell in a path away from an inlet aperture of the collision cell and towards an outlet aperture of the collision cell. The inlet aperture is an aperture at which ions normally enter the collision cell from the Q1 mass filter stage and the outlet aperture is an aperture at which ions normally exit the collision cell to the mass analyzer stage. Although it is desirable to apply the drag field as described above, it is not absolutely necessary. For instance, one could method 300 in the presence of collision gas and with no drag field. Such a method would lack optimal performance, however.

In Step 314, the operation of the Q1 stage is changed from mass filtering or mass isolating to the operation of mass scanning across a region of m/z encompassing the anticipated location and width of the known precursor ion peak. The scanned ions are transmitted to the collision cell using ions and pass through the collision cell using the reduced collision energy and with the drag field optionally applied. The transmitted scanned ions are detected with a detector of the mass analyzer stage. If the mass analyzer stage comprises a quadrupole apparatus (Q3), that quadrupole may be operated in RF-only mode such that Q3 acts as a simple transmission device which transmits the ions, as they are scanned out of Q1, to a detector. The act of scanning includes varying one or more voltage amplitudes applied to electrodes of Q1 such that the through-transmitted mass-to-charge is caused to vary.

The ions that are analyzed in Step 314 are those ions that are scanned by Q1 and transmitted to the mass analyzer through the collision cell with the reduced collision energy and optional drag field applied. The drag field within the collision cell permits the ions to be transmitted through the increased pressure environment of the collision cell to the mass analyzer stage. The negligible collision energy enables the precursor ion to survive such transit through the collision cell without fragmentation. The greater the magnitude of the drag field, the more closely the detected peaks will resemble the conditions in the absence of collision gas. With no drag field, one could monitor for changes, but with poor results. The quality of results tends to improve with increasing drag field. However, if the magnitude of the drag field that is too great, then fragmentation will begin again (i.e., the drag field will behave as imparted "collision energy").

The magnitude of the transmission across the partial mass spectrum determined in Step 314 scan of Q1, as measured by the detector 48, permits determination of the ion peak centroid mass intensity and position (with regard to the scanned Q1 instrumental parameters) as well as the mass resolution of Q1. According to known methods of operating quadrupoles, the scanning procedure may include varying one or more instrumental parameters such as varying a DC voltage applied between a first pair of electrodes and a second pair of electrodes, varying an amplitude or a frequency of an oscillatory RF voltage applied between the electrode pairs, varying the amplitude or frequency of an auxiliary AC voltage applied between the electrode pairs or some combination of the above.

In Step 315, the operation of the Q1 stage may be changed to RF-only mode such that all potential precursor ions are simply transmitted through Q1 to the collision cell. The collision cell is operated with the reduced collision energy and, optionally, with the drag field applied such that the ions are transmitted to the mass analyzer stage. The transmitted ions are analyzed, using the mass analyzer, across a region encompassing the anticipated location and width of the same precursor ion peak. If the mass analyzer stage comprises a quadrupole apparatus (Q3), the mass analysis may be performed by scanning that quadrupole across the m/z region of the precursor ion of interest. This procedure permits determination of the ion peak centroid mass intensity and position (with regard to the scanned Q3 instrumental parameters) as well as determination of the mass resolution of Q3. In step 316, the collision energy (CE) is reset and the drag field is set to zero in anticipation of possible subsequent execution of steps 306-310. In the decision step, Step 317, if additional precursor ions of the sample are to be selected for processing and/or detection, execution branches back to Step 306; otherwise, execution branches to Step 318.

Figure 3:
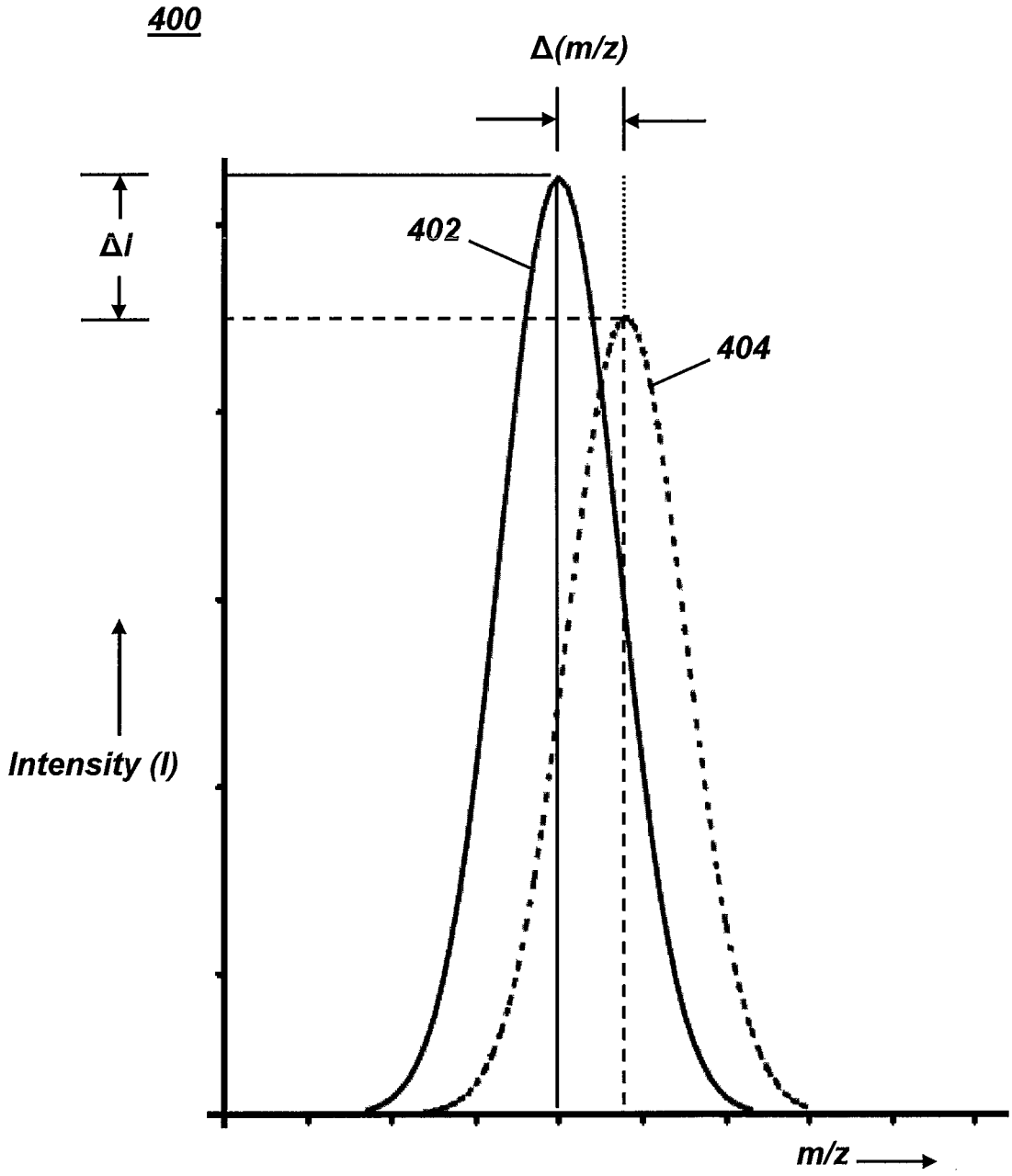
FIG. 3 is a schematic diagram of hypothetical observed and expected peaks as may be observed as a result of steps in a mass spectrometer calibration procedure in accordance with the present teachings.

In the decision step, Step 318, the results of the various mass scans of the Q1 and mass analyzer stages are compared to their respective expected values. The results may include one or more profiles of the detected ion intensity of one or more precursor ions versus the particular scanned instrumental parameter or parameters. The expected values may be the expected results based on a prior calibration or re-calibration. In a best case scenario, the peak centroid position, peak width and mass resolution for all measured precursor ions will be will be within expectations with respect to a previously performed calibration. In this situation, execution branches back to Step 302 at which point a new sample is introduced into the mass spectrometer. However, in more-general scenarios, the will be some observed drift or change in one or more of these peak properties, due to temperature changes, voltage drifts, etc. For example, FIG. 3 schematically illustrates both a hypothetical expected mass spectral curve 402 of a precursor ion of known concentration and a hypothetical observed mass spectral curve 404 of the precursor ion. The centroid positions of the hypothetical expected curve 402 and the hypothetical observed curve 404 are denoted by the solid and dashed vertical lines, respectively. Such centroids, as well as peak widths and amplitudes may be calculated by mathematical post-processing of spectral data. In the example shown in FIG. 3, the observed m/z ratio and observed intensity, I, are in error (assuming the prior calibration to be accurate) by $\Delta(m/z)$ and $\Delta I$, respectively, where, in the illustrated case, $\Delta(m/z)>0$ and $\Delta I<0$. The magnitude of the differences are exaggerated in FIG. 3 for purposes of illustration. In practices, differences on the order of 0.050 m/z will trigger an action, such as those listed in Steps 324-328.

If, in Step 318 of the method 300 shown in FIG. 2A, the drift or other deviation from expectations is experimentally negligible, then execution may pass back to the experimental step 302 so that additional samples may be analyzed using the existing calibrations. More particularly, the notion of drift being experimentally negligible generally means, in this regard, that all of the quantities of mass-axis error, $\Delta(m/z)$, intensity error, $\Delta I$, and peak width error, $\Delta w$ (not illustrated in FIG. 3), are within respective pre-determined tolerances for these error quantities. In some instances, depending upon experimental or user requirements, it may be necessary to employ only a subset of the above-listed set of tolerances in the decision process. For example, if a set of experiments are being conducted so as to only determine the presence (versus the absence) of certain molecules but not their actual abundance, then the intensity error may possibly be ignored.

If drift from expected values is not negligible, as defined above, the execution of the method 300 passes from Step 318 to step 324, in which a data quality score is calculated based on the magnitude of any deviations from expected results observed in the calibration check steps. The data quality score provides users with a measure of the reliability, usefulness or accuracy of recently acquired data from unknown samples. For example, the data scores may reference a simple three-point scale wherein a value of 2 indicates that the results are within tolerance and the sample analyses are good, a value of 1 indicates that the results are at the tolerance boundaries and that the sample analyses are suspect and should be manually reviewed and a value of 0 indicates that the experimental results are out of tolerance and the sample analyses should not be used. In Step 326, a determination may be made as to whether the mass calibration or resolution has drifted to such an extent that a recalibration procedure is necessary. Even if immediate re-calibration is not necessary, the degree of deviation of measured results from the expected values may be used, in Step 326, to monitor or provide a record of the degree of deviation over time to predict when, in the future, recalibration or, perhaps, system cleaning will be necessary.

In some circumstances, an adjustment of the existing calibration may be performed automatically in Step 328, based on the observed deviations from expected results as determined from the data acquired during the precursor ion scans of both the Q1 and mass analyzer stages (Steps 314-315). For example, referring again to FIG. 3, correction may be applied to an observed intensity values, $I_1$, by simply multiplying by a correction factor. Likewise, the mass-axis scale may be adjusted by making appropriate corrections to voltages applied to electrodes. Additionally, previously acquired data may be recalibrated or recalculated in Step 324 by making post-acquisition corrections to stored data. Any required recalibrations or adjustments to the previously acquired sample data may be made immediately or, alternatively or additionally, a notification may be provided that the data files in question may require further post-acquisition analysis. The comparisons between observed and expected performance described above may be used—either immediately or during subsequent post-acquisition processing—to determine the suitability of results of a batch of assays. Also, these comparisons may be monitored over time to evaluate, identify and predict system failures or to advise a user that a full system tune and calibration should be performed at their next convenience and, possibly, a time deadline for performing such full system tune and calibration.

The exemplary method 300 illustrated in FIG. 2A includes both the steps of scanning a precursor ion using Q1 (Step 314) and of scanning the precursor ion using the mass analyzer stage (Step 315). However, either or both of these steps may be bypassed in any particular iteration or the steps may be reversed in sequence. Also, the exemplary method 300 shows both an MS/MS analysis (Steps 306-310) as well as a calibration verification (Steps 312-316) being performed on a single sample. Further, the calibration verification steps are illustrated is being performed considering one precursor ion at a time. In other words, the flow of execution of steps indicated in method 300 implies that each iteration of Steps 314, 315 applies only to an individual precursor ion. Although the flow of execution indicated in FIG. 2A may be appropriate when there are only a small number of precursor ions of interest or that are necessary for calibration verification, it may be overly wasteful of time in other circumstances.

Figure 2B:
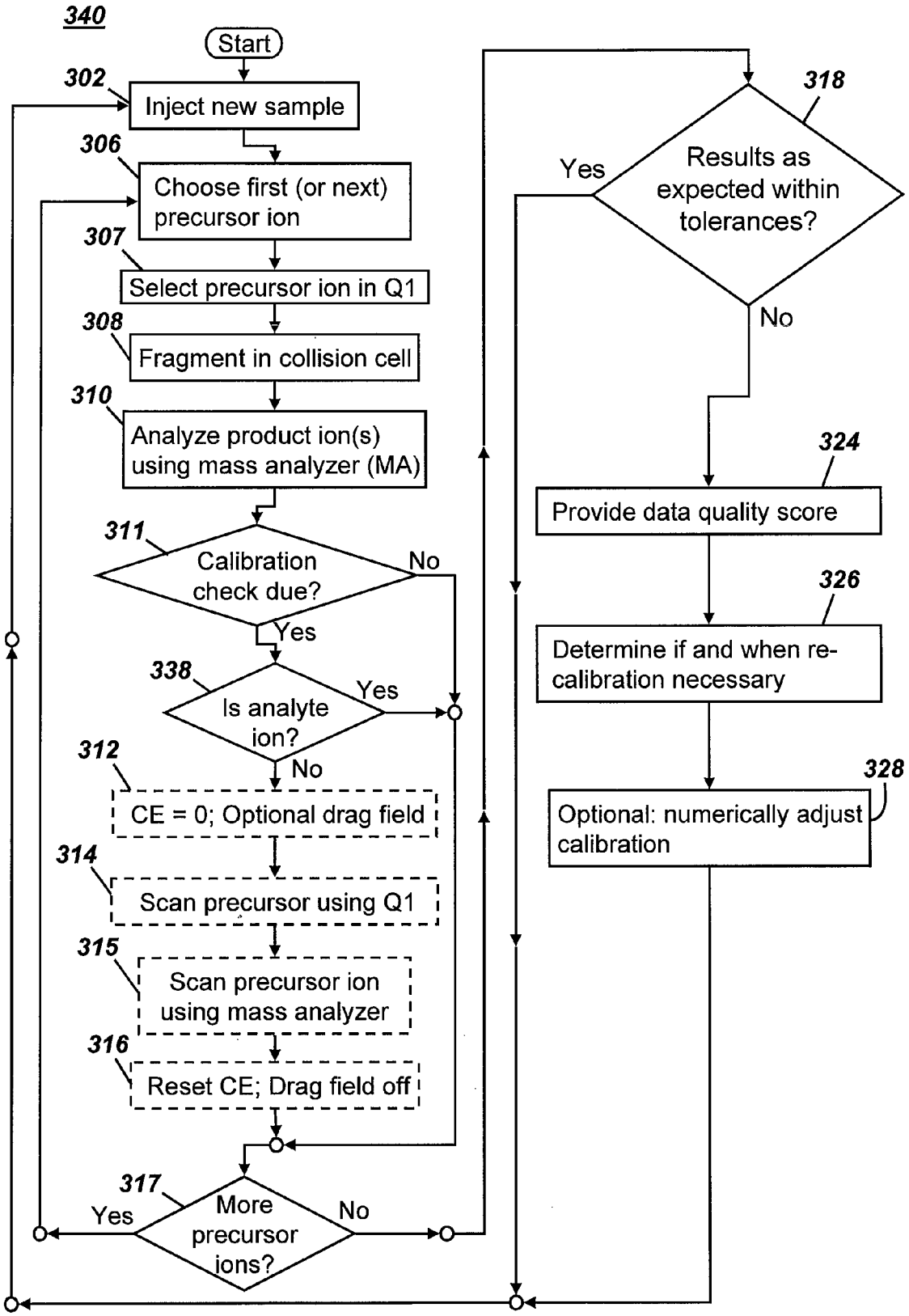
FIG. 2B is a flow chart of an alternative method for operating a mass spectrometer while periodically checking and, optionally, adjusting a calibration of the mass spectrometer in accordance with the present teachings.

One of ordinary skill in the art can readily envision many variations in the sequence of steps shown in FIG. 2A in order to improve efficiency. FIG. 2B illustrates an alternative method 340 that includes one such variation. The method 340 illustrated in FIG. 2B is similar, in must regards, to the method 300 of FIG. 2A, but includes a new decision step, Step 338 immediately after Step 311. Step 338 provides that the calibration check steps 312-316 will be bypassed if the precursor ion in question is an ion from an analyte material—that is, a substance whose unknown abundance is being determined by the mass spectrometer. In other embodiments, Step 338 could alternatively be formulated so that the calibration check steps are executed only if the precursor ion in question is derived from an internal standard material.

Figure 2C:
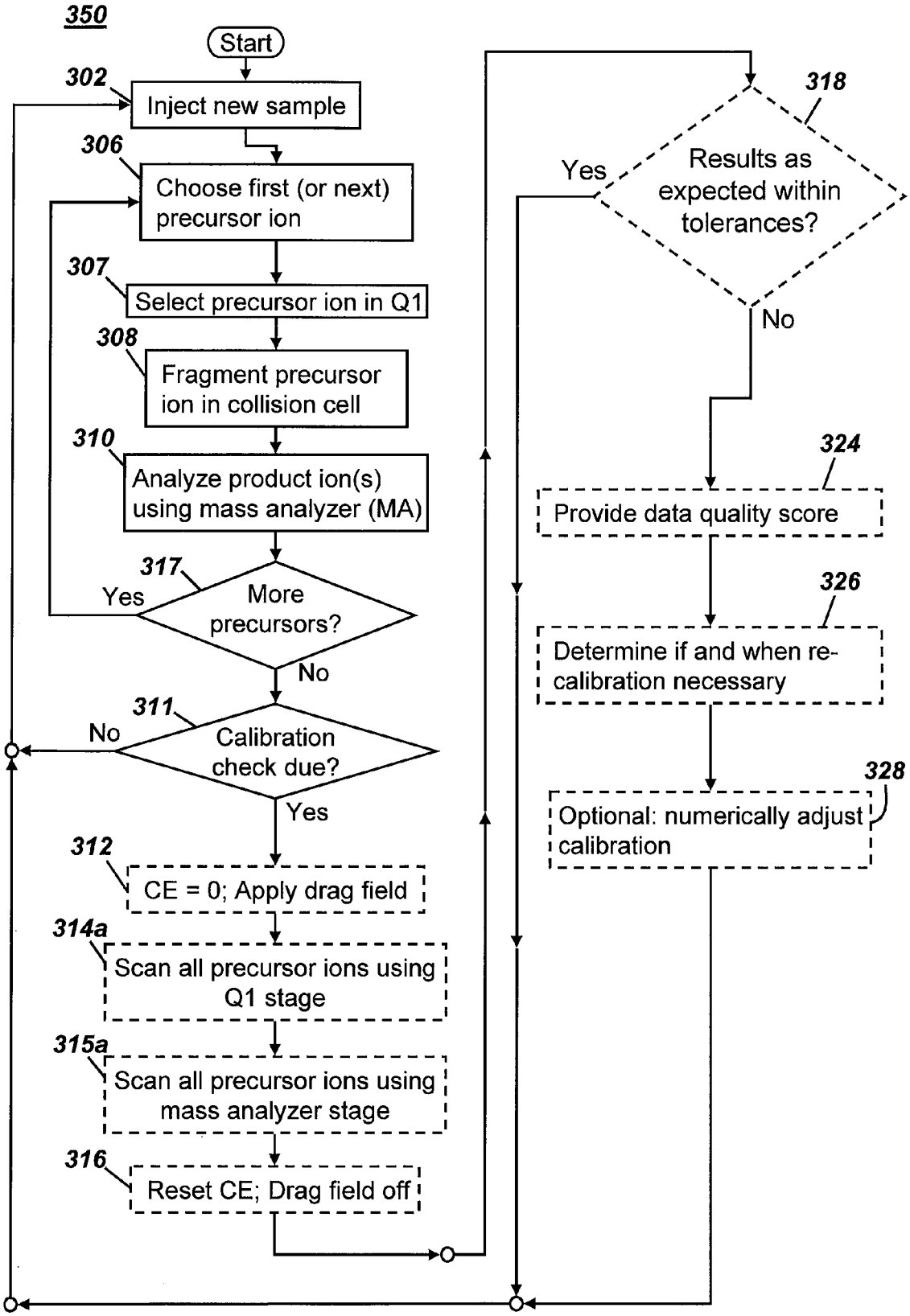
FIG. 2C is a flow chart of another alternative method for operating a mass spectrometer while periodically checking and, optionally, adjusting a calibration of the mass spectrometer in accordance with the present teachings.

A few additional variations are illustrated in the method 350 presented in FIG. 2C. In the method 350 shown in FIG. 2C, the loop termination step (Step 317), which terminates the processing of each precursor ion, is moved so as to occur immediately after Step 310 and prior to determining if calibration checking is required. The Step 311 in method 350 causes the steps associated with calibration verification (Steps 312-328) to be bypassed for any sample for which a calibration check is not due. Further, in the method 350, the modified Steps 314*a*, 315*a* replace the steps 314 and 315, respectively of the method 300. In the Step 314*a*, the Q1 stage is operated in scanning mode so as to scan all precursor ions of interest (for example, a full scan) and these are all passed through to the detector of the mass analyzer so as to yield a mass spectrum. This contrasts with the previously described methods in which one precursor ion at a time is scanned. In Step 315*a*, the Q1 stage is set to RF-only mode, so as to pass all ions, and a mass analysis of all precursor ions of interest (for example, as in a full scan of a quadrupole apparatus) is performed in the mass analyzer stage so as to yield a mass spectrum. Because multiple precursor ions are analyzed together, the calibration verification steps (Steps 312-328) are moved out of the loop initiated in Step 306 and terminated in Step 317. Accordingly, in the method 350, Step 318 is executed immediately after the execution of Step 316. Clearly, one of ordinary skill in the art can readily envision many other variations or flow of execution of various steps, depending on the needs or preferences of analysts or instrument providers. For example, the restriction of execution of calibration check steps such that they are executed only with regard to non-analyte precursor ions or only with regard to internal standard precursor ions could be incorporated into the method 350. All such variations are considered to be within the scope of the invention.

The above-described method employs a drag field applied to ions in the collision cell. Accordingly FIGS. 4A-4C and the following discussion illustrate and describe, in non-limiting fashion, examples of apparatuses which may be employed to provide such drag fields. For additional details, the interested reader is referred to U.S. Pat. No. 7,675,031, in the names of Konicek et al.

Figures 4A, 4B:
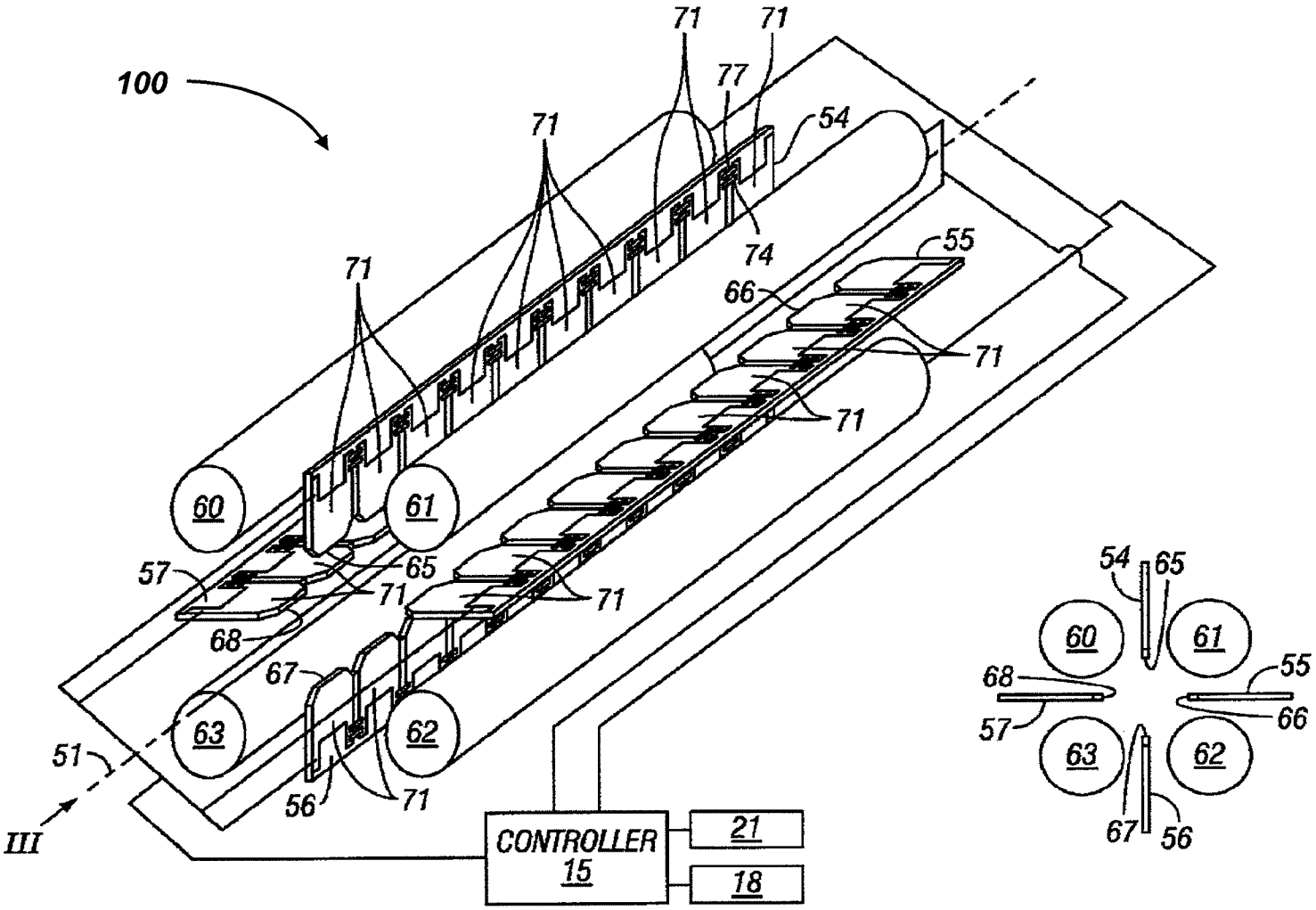
FIG. 4A is a diagrammatic perspective view of an example of a multipole apparatus capable of providing a drag field.
FIG. 4B is an end view of the multipole apparatus of FIG. 4A.

FIG. 4A shows a first example of a multipole device 100 capable of providing a drag field, wherein auxiliary electrodes 54, 55, 56, 57, configured with one or more finger electrodes 71, are designed to be disposed between adjacent pairs of main rod electrodes 60, 61, 62, 63 of the collision cell 36 of FIG. 1A. The relative positioning of the main rod electrodes 60, 61, 62, 63 and auxiliary electrodes 54, 55, 56, 57 in FIG. 4A is somewhat exploded for improved illustration. However, the auxiliary electrodes can occupy positions that generally define planes that intersect on a central axis 51, as shown by the directional arrow as referenced by the Roman Numeral III. These planes can be positioned between adjacent RF rod electrodes at about equal distances from the main RF electrodes of the multipole device where the quadrupolar fields are substantially zero or close to zero, for example. Thus, the configured arrays of finger electrodes 71 can lie generally in these planes of zero potential or close to zero potential so as to minimize interference with the quadrupolar fields. FIG. 4B shows an end view perspective of the configuration of FIG. 4A, illustrating how the radial inner edges 65, 66, 67, and 68 of the auxiliary electrodes 54, 55, 56, and 57, may be positioned relative to the main rod electrodes 60, 61, 62, 63.

Turning back to FIG. 4A, as known to those of ordinary skill in the art, opposite RF voltages may be applied to each pair of oppositely disposed main RF electrodes by the electronic controller to contain the ions radially in a desired manner. The array of finger electrodes 71, which are configured on the each of the auxiliary electrodes 54, 55, 56, 57, may be designed to extend to and/or form part of the radially inner edges 65, 66, 67, 68 of such structures. Thus, a voltage applied to the array of finger electrodes 71 creates an axial electric field in the interior of collision cell 36 depicted in FIG. 1A. As another example arrangement, each electrode of the array of finger electrodes 71 may be connected to an adjacent finger electrode 71 by a predetermined resistive element 74 (e.g., a resistor) and in some instances, a predetermined capacitor 77. The desired resistors 74 set up respective voltage dividers along lengths of the auxiliary electrodes 54, 55, 56, 57. The resultant voltages on the array of finger electrodes 71 thus form a range of voltages, often a range of step-wise monotonic voltages. The voltages create a voltage gradient in the axial direction that urges ions along the ion path 45, as shown in FIG. 1A. In the example device shown in FIG. 4A, the voltages applied to the auxiliary electrodes often comprise static voltages, and the resistors often comprise static resistive elements. The capacitors 77 reduce an RF voltage coupling effect in which the RF voltages applied to the main RF rod electrodes 60, 61, 62, 63 typically couple to and heat the auxiliary electrodes 54, 55, 56, 57 during operation of the RF rod electrodes 60, 61, 62, 63.

Figure 4C:
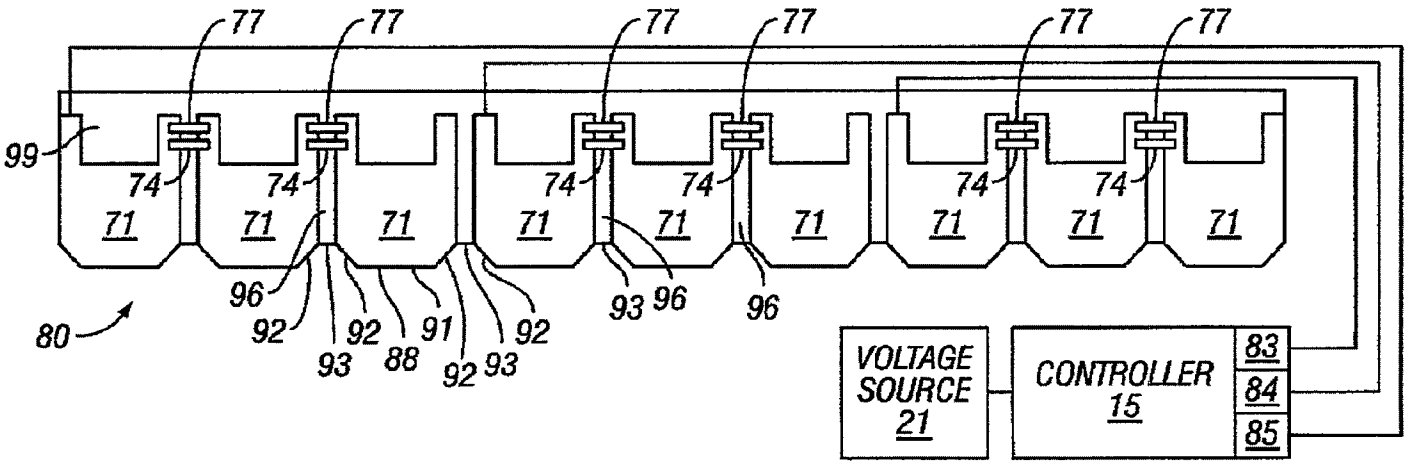
FIG. 4C is a diagrammatic top view of an auxiliary electrode structure for providing a drag field within a multipole apparatus.

In an alternative device, as shown in FIG. 4C, one or more of the auxiliary electrodes can be provided by an auxiliary electrode, as shown generally designated by the reference numeral 80, which has dynamic voltages applied to one or more of the array of finger electrodes 71. In this example arrangement, the controller 15, as shown in FIG. 1A, may include or have added thereto computer controlled voltage supplies 83, 84, 85, which may take the form of Digital-to-Analogue Converters (DACs). It is to be understood that there may be as many of these computer controlled voltage supplies 83, 84, 85 as there are finger electrodes 71 in an array, and that each computer controlled voltage supply may be connected to and control a voltage of a respective finger electrode 71 for the array. As an alternate arrangement, each of the finger electrodes 71 at a particular axial position for all of the arrays in a multipole device may be connected to the same computer controlled voltage supply and have the same voltage applied. In the example device shown in FIG. 4C, each computer controlled voltage supply 83, 84, 85, can be connected to predetermined finger electrodes 71 of the array. When implemented on plural auxiliary electrodes, each computer controlled voltage supply 83, 84, 85, may be applied to a like plurality of each array of finger electrodes 71.

As shown in FIG. 4C, and as briefly discussed above, the auxiliary electrode 80, may as one arrangement, have designed voltages applied by a combination of dynamic computer controlled voltage supplies and voltage dividers in the form of static resistors 74 so as to form an overall monotonically progressive range of voltages along a length of a multipole device. The static resistors 74 between the finger electrodes 71 within a group of finger electrodes 71 that are connected to a respective computer controlled voltage supplies 83, 84, 85, may further provide a voltage divider that contributes to the creation of a monotonically progressive voltage gradient. Because the voltage supplies 83, 84, 85 are capable of being dynamically controlled via, for example, a computer, the magnitude and range of voltages may be adjusted and changed to meet the needs of a particular sample. As also shown in FIG. 4C, capacitors 77 may be connected between adjacent finger electrodes 71. It is to be appreciated, that even though there are two leads shown on each of the finger electrodes 71, a single lead having coupled resistors and capacitors on each side can be also be utilized to depict the interconnection of adjacent finger electrodes so as to still function similarly to the example configuration of FIG. 4C.

FIG. 4C also shows in detail, the configuration of a radially inner edge 88 that is similar to the radially inner edges 65, 66, 67, 68, described above for FIG. 4A and FIG. 4B. The radially inner edge 88 includes a central portion 91 that may be metalized or otherwise provided with a conductive material, tapered portions 92 that straddle the central portion 91, and a recessed gap portion 93. The central portions 91 may be metalized in a manner that connects metallization on both the front and the back of the auxiliary electrode 80 for each of the finger electrodes 71 of the array of finger electrodes. As an innermost extent of the auxiliary electrode 80, the central portion 91 presents the DC electrical potential in close proximity to the ion path. Gaps 96 including recessed gap portions 93 are needed between metallization of the finger electrodes 71 in order to provide an electrical barrier between respective finger electrodes. However, these gaps offer a resting place for charged particles such that charged particles may reside on the surfaces in the gaps and adversely affect the gradient that is intended to be created by the voltages applied to the finger electrodes 71. Thus, the non-metalized edge surfaces of the tapered portions 92 and the recessed gap portions 93 are tapered back and away from the radially innermost extent such that the edge surfaces of the tapered portions 92 and the recessed gap portions 93 are not as accessible as dwelling places for charged particles.

It should be noted that although FIG. 4 illustrates one mechanism for producing a drag field in a collision cell, one of ordinary skill in the art will be familiar with many alternative apparatus configurations which can perform the same or a similar function. For instance, U.S. Pat. No. 5,847,386 (Thomson and Jolliffe, inventors) indicates such fields can be created by tapering quadrupole rods, or by arranging the rods at angles with respect to each other, or by segmenting the rods, or by providing a segmented case around the rods, or by providing resistively coated or segmented auxiliary rods, or by providing a set of conductive metal bands spaced along each rod with a resistive coating between the bands, or by forming each rod as a tube with a resistive exterior coating and a conductive inner coating, or by other appropriate methods. Accordingly, one of skill in the art will understand how to modify such techniques in order to provide a drag field of the type described herein.

Improved apparatus and methods for calibrating a mass spectrometer have been disclosed. The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention. Any publications, patents or patent application publications mentioned in this specification are explicitly incorporated by reference in their respective entirety.

What is claimed is:

1. A method for automatically checking a calibration of a mass spectrometer including an atmospheric pressure ion source, a first quadrupole device (Q1), a fragmentation cell and a mass analyzer comprising another quadrupole device (Q3) during a sequence of mass analyses of a plurality of samples introduced into the atmospheric pressure ion source and analyzed using the mass analyzer, comprising:

(a) providing a one of the plurality of samples having therein at least one known chemical entity;

(b) decreasing a kinetic energy applied to ions entering the fragmentation cell so as to prevent fragmentation therein;

(c) ionizing the at least one known chemical entity using the ion source so as to generate ions of a known ionic species;

(d) performing a mass scan of a portion of the ions using Q1;

(e) transmitting the scanned ions from Q1 to the fragmentation cell so as to be transmitted through the fragmentation cell to Q3 and through Q3 to a detector of the mass analyzer, wherein Q3 is operated in RF-only mode;

(f) detecting the scanned and transmitted ions by the detector; and (g) comparing the results of the detection of the scanned transmitted ions with expected results, said expected results derived from a prior calibration.

2. A method as recited in claim 1, wherein the step (a) of providing a one of the plurality of samples having therein at least one known chemical entity comprises providing an analytical sample having therein an analyte and an internal standard that is chemically similar to but not identical to the analyte, wherein the at least one known chemical entity comprises the internal standard.

3. A method as recited in claim 1, wherein the step (a) of providing a one of the plurality of samples having therein at least one known chemical entity comprises interspersing a standard sample having an internal standard therein between two of the plurality of samples that do not contain the internal standard and that contain an analyte that is chemically similar to but not identical to the internal standard, wherein the at least one known chemical entity comprises the internal standard.

4. A method as recited in claim 1, wherein the step (a) of providing a one of the plurality of samples having therein at least one known chemical entity comprises providing an analyte-specific calibration sample, wherein the at least one known chemical entity is identical to an analyte.

5. A method as recited in claim 1, wherein the step (a) of providing a one of the plurality of samples having therein at least one known chemical entity comprises providing an Analytical Quality Control sample having a certified reference material therein, wherein the at least one known chemical entity comprises the certified reference material.

6. A method as recited in claim 1, wherein the step (e) of transmitting the scanned ions from Q1 to the fragmentation cell so as to be transmitted through the fragmentation cell comprises transmitting the scanned ions through the fragmentation cell under the application of a drag field to the fragmentation cell.

7. A method as recited in claim 6, wherein the transmitting of the scanned ions through the fragmentation cell under the application of a drag field to the fragmentation cell includes applying the drag field so as to urge the scanned ions to follow a non-linear path through the fragmentation cell.

8. A method as recited in claim 1, further comprising:

(h) determining, from the comparison, if any of a peak centroid position, peak intensity, peak width or peak resolution differs from a respective expected value derived from a prior calibration of mass-to-charge ratio or abundance by greater than a respective tolerance; and (i) adjusting a calibration applied to one or more of the plurality of samples if any of the peak centroid position, peak intensity, peak width or peak resolution differs from the respective expected value by greater than the respective tolerance.

9. A method as recited in claim 8, further comprising:

(j) increasing a kinetic energy applied to ions entering the fragmentation cell so as to render the fragmentation cell operable to cause ion fragmentation therein;

(k) discontinuing application of the drag field, if any, applied to the fragmentation cell;

(l) introducing a next sample of the plurality of samples into the mass spectrometer;

(m) mass analyzing the next sample with the mass spectrometer using the adjusted calibration.

10. A method as recited in claim 1, further comprising:

(h) determining, from the comparison, if any of a peak centroid position, peak intensity, peak width or peak resolution differs from a respective expected value derived from a prior calibration of mass-to-charge ratio or abundance by greater than a respective tolerance; and (i) providing a notification, if any of the peak centroid position, peak intensity, peak width or peak resolution differs from the respective expected value by greater than the respective tolerance.

11. A method as recited in claim 10, wherein the notification comprises a data quality score.

12. A method as recited in claim 11, wherein the data quality score may assume different values respectively indicating that the results are within tolerance, that the results are at the tolerance boundaries and that the results are out of tolerance.

13. A method as recited in claim 10, wherein the notification comprises a prediction of a time when a recalibration of the mass spectrometer will be necessary.

14. A method as recited in claim 10, wherein the notification comprises a record of a variation with time of the peak centroid position, peak intensity, peak width or peak resolution.

15. A method as recited in claim 1, wherein the calibration is a calibration of mass-to-charge ratio, wherein the plurality of samples comprises a plurality of clinical laboratory samples, and wherein each one of the at least one known chemical entity is either an internal standard, an analyte-specific calibrant that is provided in a known concentration or an Analytical Quality Control sample.

16. A method for automatically checking a calibration of a mass spectrometer including an atmospheric pressure ion source, a first quadrupole device (Q1), a fragmentation cell, and a mass analyzer during a sequence of mass analyses of a plurality of samples introduced into the atmospheric pressure ion source, comprising:

(a) providing a one of the plurality of samples having therein at least one known chemical entity;

(b) decreasing a kinetic energy applied to ions entering the fragmentation cell so as to prevent fragmentation therein;

(c) ionizing the at least one known chemical entity using the ion source so as to generate ions of a known ionic species;

(d) transmitting a portion of the ions through Q1;

(e) transmitting the portion of the ions from Q1 to the fragmentation cell so as to be transmitted through the fragmentation cell to the mass analyzer;

(f) performing a mass analysis of the transmitted ions by the mass analyzer and an ion detector configured to receive ions from the mass analyzer;

(g) comparing the results of the mass analysis with expected results; and (h) determining, from the comparison, if any of a peak centroid position, peak intensity, peak width or peak resolution differs from a respective expected value derived from a prior calibration of mass-to-charge ratio or abundance by greater than a respective tolerance.

17. A method as recited in claim 16, wherein the step (f) of performing a mass analysis of the transmitted ions by the mass analyzer comprises performing the mass analysis using a time-of-flight (TOF) mass analyzer.

18. A method as recited in claim 16, wherein the step (f) of performing a mass analysis of the transmitted ions by the mass analyzer comprises performing the mass analysis using an electrostatic trap mass analyzer.

19. A method as recited in claim 16, wherein the step (f) of performing a mass analysis of the transmitted ions by the mass analyzer comprises performing the mass analysis using a quadropole mass analyzer.

20. A method as recited in claim 16, wherein the step (a) of providing a one of the plurality of samples having therein at least one known chemical entity comprises providing an analytical sample having therein an analyte and an internal standard that is chemically similar to but not identical to the analyte, wherein the at least one known chemical entity comprises the internal standard.

21. A method as recited in claim 16, wherein the step (a) of providing a one of the plurality of samples having therein at least one known chemical entity comprises interspersing a standard sample having an internal standard therein between two of the plurality of samples that do not contain the internal standard and that contain an analyte that is chemically similar to but not identical to the internal standard, wherein the at least one known chemical entity comprises the internal standard.

22. A method as recited in claim 16, wherein the step (a) of providing a one of the plurality of samples having therein at least one known chemical entity comprises providing an analyte-specific calibration sample, wherein the at least one known chemical entity is identical to an analyte.

23. A method as recited in claim 16, wherein the step (a) of providing a one of the plurality of samples having therein at least one known chemical entity comprises providing an Analytical Quality Control sample having a certified reference material therein, wherein the at least one known chemical entity comprises the certified reference material.

24. A method as recited in claim 16, wherein the step (e) of transmitting the ions from Q1 to the fragmentation cell so as to be transmitted through the fragmentation cell to the mass analyzer comprises transmitting the scanned ions through the fragmentation cell under the application of a drag field to the fragmentation cell.

25. A method as recited in claim 24, wherein the transmitting of the scanned ions through the fragmentation cell under the application of a drag field to the fragmentation cell includes applying the drag field so as to urge the scanned ions to follow a non-linear path through the fragmentation cell.

26. A method as recited in claim 16, further comprising:

(i) adjusting a calibration applied to one or more of the plurality of samples if any of the peak centroid position, peak intensity, peak width or peak resolution differs from the respective expected value by greater than the respective tolerance.

27. A method as recited in claim 26, further comprising:

(j) increasing a kinetic energy applied to ions entering the fragmentation cell so as to prevent fragmentation therein;

(k) discontinuing application of the drag field, if any, applied to the fragmentation cell;

(l) introducing a next sample of the plurality of samples into the mass spectrometer;

(m) mass analyzing the next sample with the mass spectrometer using the adjusted calibration.

28. A method as recited in claim 16, further comprising:

(i) providing a notification, if any of the peak centroid position, peak intensity, peak width or peak resolution differs from the respective expected value by greater than the respective tolerance.

29. A method as recited in claim 28, wherein the notification comprises a data quality score.

30. A method as recited in claim 29, wherein the data quality score may assume different values respectively indicating that the results are within tolerance, that the results are at the tolerance boundaries and that the results are out of tolerance.

31. A method as recited in claim 28, wherein the notification comprises a prediction of a time when a recalibration of the mass spectrometer will be necessary.

32. A method as recited in claim 28, wherein the notification comprises a record of a variation with time of the peak centroid position, peak intensity, peak width or peak resolution.

33. A method as recited in claim 16, wherein the calibration is a calibration of mass-to-charge ratio, wherein the plurality of samples comprises a plurality of clinical laboratory samples, and wherein each one of the at least one known chemical entity is either an internal standard, an analyte-specific calibrant that is provided in a known concentration or an Analytical Quality Control sample.

* * * * *